US005423490A

United States Patent [19]

Zampini

[11] Patent Number: 5,423,490

[45] Date of Patent: Jun. 13, 1995

[54] METHOD AND DEVICE FOR FLUIDIZED BED JET MILL GRINDING

[75] Inventor: Stefano Zampini, Augsburg, Germany

[73] Assignee: Hosokawa Alpine Aktiengesellschaft, Augsburg, Germany

[21] Appl. No.: 172,445

[22] Filed: Dec. 21, 1993

[30] Foreign Application Priority Data

Dec. 22, 1992 [DE] Germany ..... 42 43 438.6

[51] Int. Cl.[6] ..... B02C 19/06

[52] U.S. Cl. ..... 241/5; 241/41

[58] Field of Search ..... 241/5, 39, 40, 41, 42, 241/43, 44

[56] References Cited

U.S. PATENT DOCUMENTS

| | | | |
|---|---|---|---|
| 1,935,344 | 11/1933 | Andrews et al. . . | |
| 1,948,609 | 2/1934 | Andrews et al. . | |
| 2,309,036 | 1/1943 | Beardsley | 241/41 |
| 2,605,144 | 7/1952 | Northup | 241/39 X |
| 2,615,907 | 10/1952 | Stanton | 241/39 X |
| 2,704,635 | 3/1955 | Trost . | |
| 2,846,150 | 8/1958 | Work | 241/39 X |
| 3,630,509 | 12/1971 | Greenlands et al. | 241/39 X |
| 3,734,413 | 5/1973 | Kaiser . | |
| 4,579,288 | 4/1986 | McDermid et al. | 241/39 |
| 4,638,953 | 1/1987 | Taylor | 241/5 X |
| 4,905,918 | 3/1990 | Selles et al. | 241/39 |
| 5,096,744 | 3/1992 | Takei et al. | 241/39 X |

FOREIGN PATENT DOCUMENTS

| | | | |
|---|---|---|---|
| 2628612 | 12/1977 | Germany | B02C 19/00 |
| 1168288 | 7/1985 | U.S.S.R. | 241/5 |

*Primary Examiner*—Timothy V. Eley
*Attorney, Agent, or Firm*—Pennie & Edmonds

[57] ABSTRACT

Method and device for fluidized jet mill grinding wherein a nozzle construction is provided in which the momentum of the jet issuing from the nozzle is varied between areas of high momentum and areas of low momentum immediately after leaving the nozzle. A drop in pressure from the periphery to the core area of the jet develops so that flow channels are formed at right angles to the flow direction of the jet. Particles of the material to be comminuted are thereby drawn into the center of the jet where they are accelerated to the impact velocity necessary for their comminution during the course of the jet travel.

18 Claims, 2 Drawing Sheets

METHOD AND DEVICE FOR FLUIDIZED BED JET MILL GRINDING

BACKGROUND OF THE INVENTION

The invention is based on the so-called fluidized bed jet milling process, in which a jet of gas or steam exiting a nozzle at high speed is introduced into a fluidized bed of granular material. The particles in the vicinity of the jet are accelerated to such a high speed that they shatter upon impact against still or approaching particles. Such a process—especially one suitable for fine grinding—is disclosed in U.S. Pat. No. 1,948,609.

A disadvantage of the process just mentioned, however, is that the kinetic energy introduced by the jet is only partially used for the actual comminution. The pressure drop in the jet with respect to the material bed causes particles to be immediately drawn into the jet and accelerated. However, such a change of momentum only takes place in the outermost peripheral zone of the jet. The core area of the jet remains practically free of product, so that the kinetic jet energy in this zone is largely unused, resulting in unsatisfactory comminution efficiency.

U.S. Pat. No. 3,734,413 describes an apparatus for forcing the product laterally into the jet by mechanical conveying means. This apparatus, however, requires a considerable amount of mechanical equipment and high power consumption. Also, the conveying equipment is subject to a high degree of wear. The same disadvantages are displayed by the well-known injector jet mills, e.g. as per U.S. Pat. No. 1,935,344 where the product is mixed with the gas or steam in an acceleration nozzle before the jet is formed.

SUMMARY OF THE INVENTION

The objective of the invention, therefore, is to load the gas or steam jets used for the fluidized bed comminution with a higher amount of product to permit better utilization of the kinetic energy introduced with the jets. An especially important factor is to create a flow pattern for moving the product into the core area of the jets, thus enabling the kinetic energy present in this zone to be optimally used.

These results are obtained by altering the magnitude of the jet momentum locally so that zones with high and low jet momentum form. This is done while maintaining the size of the emission cross-section of the known nozzle. These zones are arranged such that the magnitude of the jet momentum in the peripheral area of the emission cross-section changes at least twice between a minimum and a maximum value. The minimum value is such that it is equal to or less than the minimum value in the core area of the cross-section. Surprisingly, it has been established that in the zones of low jet momentum immediately after the jet exits the nozzle, flow patterns akin to flow channels are created at right angles to the flow direction of the jet with a pressure drop from the peripheral to the core area of the jet, so that here, the particles of product are drawn right into the center of the jet. Here, they are accelerated to the impact velocity necessary for their comminution.

During the course of jet travel, mixing processes resulting from an overlapping of the individual jet zones cause the jet momentum across the jet cross-section to even out; and a velocity distribution across the jet cross-section similar to that of a single jet eventually occurs. Because the product is drawn into the core area of the jet, a much higher amount of product can be picked up than with a single jet, and the particles are accelerated to a higher velocity.

DETAILED DESCRIPTION OF THE INVENTION

Figure 1:
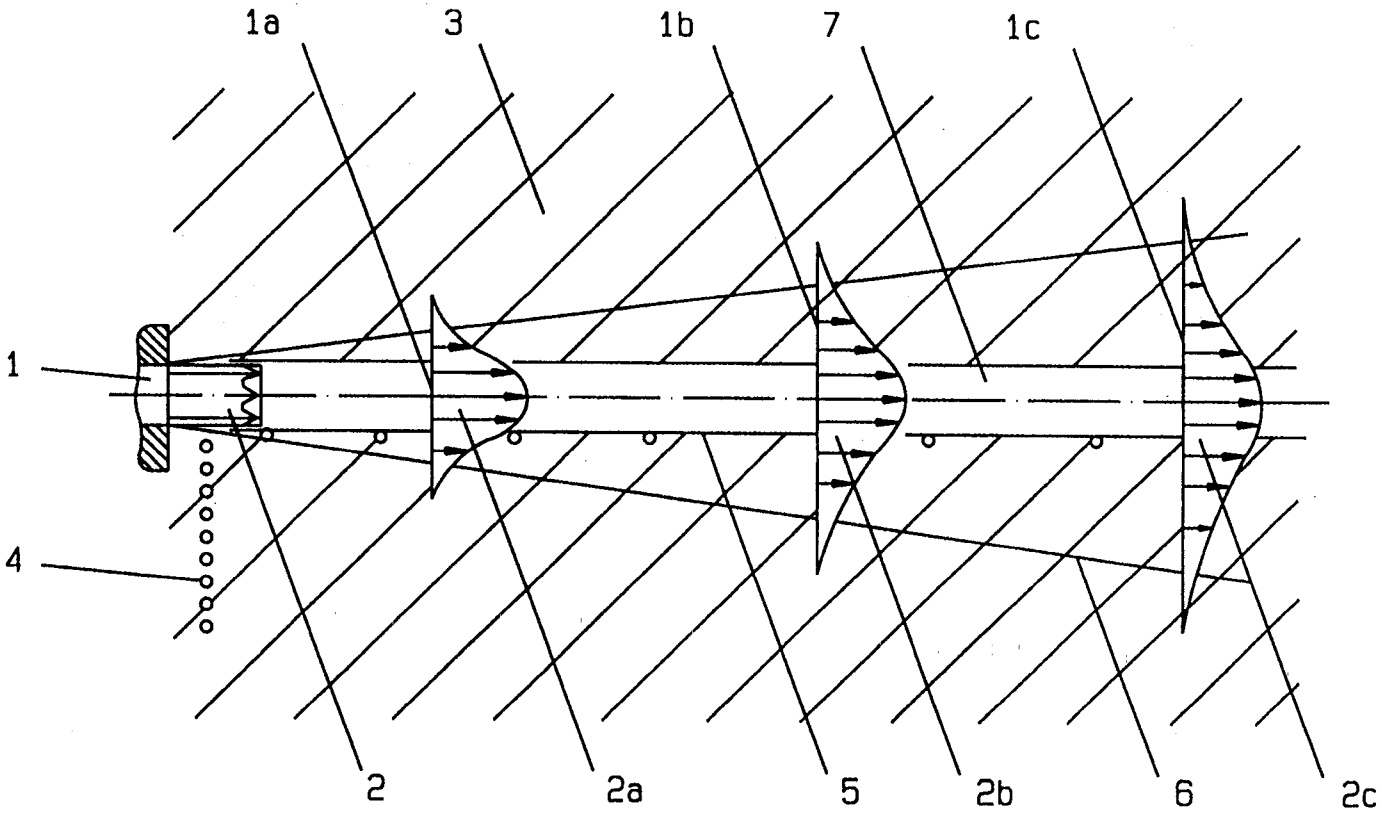
FIG. 1 Prior Art
FIG. 1 is a schematic view showing the velocity flow pattern of a single nozzle jet of the prior art.

As shown schematically in FIG. 1, the jet enters the bed of material 3 at a velocity distribution 2 which is distributed uniformly across the emission outlet cross-section 1. The pressure drop in the jet with respect to the material bed causes particles 4 to be immediately drawn into the jet and accelerated. This is made clear by the increasing distance between two particles 4. However, such a change of momentum only takes place in the outermost peripheral area of the jet between the lines 5 and 6, which are intended to represent the surface lines of the peripheral area. The jet velocity here decreases the further the jet travels along the longitudinal axis of flow. This is confirmed by the velocity distributions 2*a*, 2*b*, and 2*c* in the jet cross-sections 1*a*, 1*b*, and 1*c*.

As shown in FIG. 1, the core area 7 of the jet remains practically free of product 4. Accordingly, the kinetic jet energy in this area is largely unused, resulting in unsatisfactory comminution efficiency.

According to the teachings of the present invention, a nozzle construction is provided with a number of separate emission areas in its peripheral area. These emission areas create a number of zones of low pressure between the emission areas in the peripheral area and also a zone of low pressure in the core area of the nozzle. As an example, one way of realizing this pressure drop is to provide local evacuation within the nozzle itself, i.e. before the jet exits the nozzle.

Technically, the simplest preferred solution is to use jet emission areas which are distributed uniformly across the jet emission cross-section.

An example of a tested nozzle which can be inserted into a holder is one which includes four circular jet emission areas 8 whose centers are arranged in a circle 15 having a diameter approximately 2.5 times that of an emission area. The flow of steam or gas exiting each emission area is aimed at a common point along the central nozzle axis 9.

Figure 2:
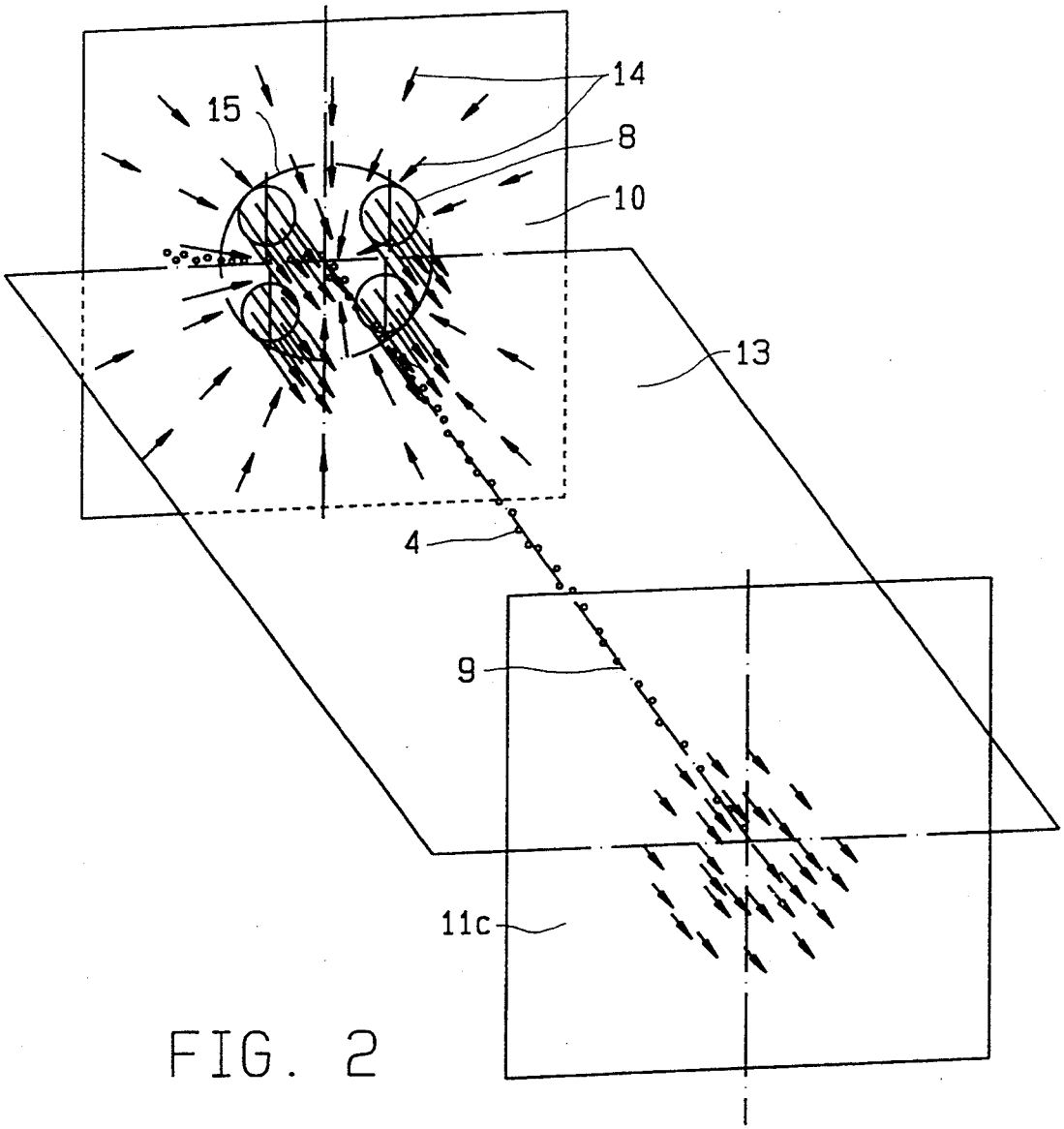
FIG. 2 is a schematic perspective view of a preferred embodiment of the nozzle construction of the present invention showing the path of flow of particles in the jet flow.

FIG. 2 schematically shows a perspective view of the flow patters at the emission cross-section 10 and at the downstream jet cross-section 11*c*. At the cross-section 11*c*, a normal velocity distribution, such as occurring at the jet cross-section 1*c* in FIG. 1, has set in. The suction effect towards the core area of the jet is optimized with this construction.

Figure 3:
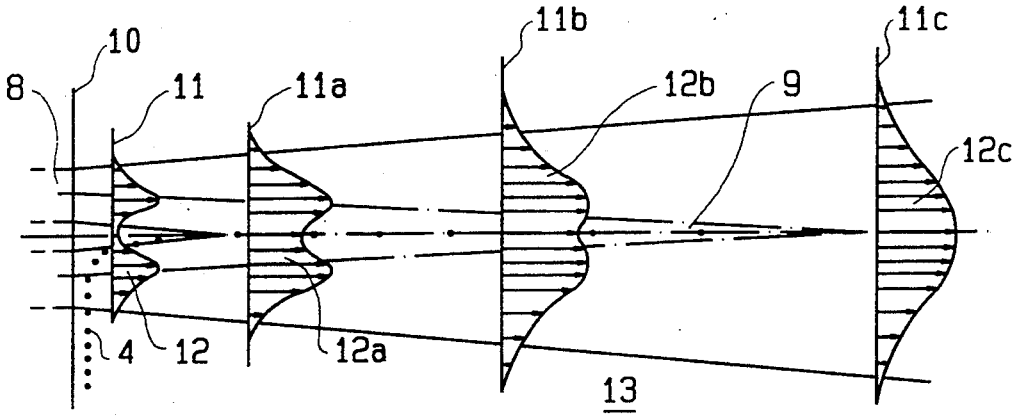
FIG. 3 is a schematic view, similar to FIG. 1, showing a portion of the velocity flow pattern of nozzle construction of FIG. 2.

FIG. 3 shows the flow patterns, as they set in at a level 13, which is positioned along the central jet axis 9 and in the middle between two emission areas 8. As shown in FIG. 3 at the emission cross-section 10 between two emission areas 8, radially directed flow channels form and extend in the direction of the jet right up to the jet cross-section 11 (with velocity distribution 12), where the individual jet zones start to intersect. The further course of the jet is shown in FIG. 3 by the velocity distributions 12*a*, 12*b* and 12*c* in the jet cross-sections 11*a*, 11*b*, and 11*c*. The arrows 14 in FIG. 2 represent the transverse flow which forms as a result of the aforementioned flow channels and which transports the particles 4 to the central jet axis 9.

There are different embodiments of the invention whereby the relative sizes of jet momentum and jet zones and the jet direction in the individual zones can be varied. These measures serve to influence the angle of spread of the jet or rather to shift the jet cross-section 11*c* with the normalized speed distribution downstream along the jet direction. This permits the achievement of a change of the jet form enabling adaptation to the size of the grinding chamber or to the product properties.

In one preferred embodiment of the invention, the level of jet momentum has the value zero at the zones where the minimum values exist. Also, in all sub-sections of the nozzle cross-section where maximum jet momentum exists, the values of momentum are more or less the same value. The same is so with respect to all sub-sections where minimum jet momentum exists. Preferably, the transition from a minimum jet momentum to a maximum occurs discontinuously.

The emission flow in every sub-section of the nozzle cross-section can occur parallel to the central nozzle axis 9, or it can be aimed toward or away from the central nozzle axis 9. Where the flows from every sub-section are aimed toward the axis 9, they can be aimed at a common point on the central nozzle axis 9.

In construction, the nozzle apparatus can be mounted in a holder to generate the jet with at least two emission areas 8 of different form and size distributed uniformly across the cross-section of the nozzle structure. Preferably, the emission areas 8 are arranged within a boundary representing an inflexion-point-free envelope curve which encloses the emission areas 8. The areas 8 are preferably designed with circular cross-sections.

Grinding tests have been carried out with a fluidized bed opposed jet mill equipped first with the prior art nozzle and then with the nozzle construction of the present invention. These tests showed that at otherwise identical operating parameters and more or less the same specific energy consumption rate (in kWh/t), more than double the throughput at the same grinding fineness was achieved with the mill equipped with the nozzle construction of the present invention than with the normally equipped mill. The grinding efficiency improved by a factor of almost 2.5.

I claim:

1. In the method for impact comminution of material particles in a fluidized bed of material wherein at least one gas or steam jet is introduced at high speed into said fluidized bed upon exiting from a nozzle means having a central nozzle axis and a nozzle cross-section, said jet defining a jet cross-section with a central core area and a surrounding peripheral area, the improvement comprising the steps of:

a) passing the jet through said nozzle means with a jet momentum which, immediately upon exiting the nozzle means, varies in the peripheral area of the jet cross-section between a minimum value at first locations and a maximum value at second locations;

b) establishing a value of jet momentum in said core area, immediately upon said jet exiting from said nozzle means, which is less than the maximum value of jet momentum in said peripheral area; and c) creating a first air pressure in said jet, immediately upon exiting from said nozzle means, which is less than a second air pressure in said second locations, said first pressure extending from said first locations to said core area to define radially inwardly directed flow channels extending from said first locations to said core area for entrainment of said particles from said first locations to said core area.

2. The method according to claim 1 wherein:

the value of jet momentum in said core area is established at a level which is no greater than about the minimum value of jet momentum in said peripheral area.

3. The method according to claim 1 wherein:

the jet is passed through said nozzle means with a jet momentum which varies in the peripheral area, as measured at said first and second locations spaced circumferentially about said peripheral area, at least twice between said minimum and maximum values.

4. The method according to claim 3 wherein:

the minimum jet momentum at said spaced locations is about equal to each other.

5. The method according to claim 4 wherein:

the maximum jet momentum at said spaced locations is about equal to each other.

6. The method according to claim 3 wherein:

the jet momentum has the value of about zero at the locations where the minimum values exist.

7. The method according to claim 3 wherein:

a transition from a minimum jet momentum to a maximum jet momentum occurs discontinuously.

8. The method according to claim 3 wherein:

the jet flow across the entire nozzle cross-section occurs parallel to the central nozzle axis.

9. The method according to claim 3 wherein:

the jet flow at each different location across the nozzle cross-section is aimed away from the central nozzle axis.

10. The method according to claim 3 wherein:

the jet flow at each different location across the nozzle cross-section points towards the central nozzle axis.

11. The method according to claim 10 wherein::

the jet flow at each different location across the nozzle cross-section is aimed at a common point on the central nozzle axis.

12. The method according to claim 1 wherein:

said second locations are spaced from said first locations by distances small enough for the jet momentum in the second locations to create said first pressure extending from said first locations to said core area and thereby define said radially inwardly directed flow channels extending from said first locations to said core area for entrainment of said particles.

13. The method according to claim 12 further including the step of:

a) progressively evening out the jet momentum in said first and second locations as the jet moves further and further away from said nozzle means.

14. A single nozzle for effecting impact comminution of material particles in a fluidized bed of material wherein at least one gas or steam jet is introduced at high speed into said fluidized bed from said nozzle, said nozzle having a central nozzle axis and a nozzle cross-section defining a central core area and a surrounding peripheral area, the improvement wherein said nozzle includes:

a) a plurality of spaced jet emission locations (8) across said nozzle cross-section; and b) means for creating a jet momentum in said emission locations (8) which is higher than in other locations of said nozzle cross-section and for creating a first pressure extending from said other locations to said core area, which first pressure is less than a second pressure in said emission locations to define radially inwardly directed flow channels extending from said other locations to said core area for entrainment of said particles from said other locations to said core area.

15. The nozzle according to claim 14 wherein:

there are at least two emission locations (8) of different form and size distributed uniformly across the cross-section of the nozzle means.

16. The nozzle according to claim 15 wherein:

the emission locations (8) are arranged within a boundary defining an inflexion-point-free envelope curve which encloses the emission locations (8).

17. The nozzle according to claim 14 wherein:

the emission locations (8) are circular in cross-section.

18. An apparatus for effecting impact comminution of material particles in a fluidized bed of material wherein at least one gas or steam jet is introduced at high speed into said fluidized bed from a nozzle means having a central nozzle axis and a nozzle cross-section defining a central core area and a surrounding peripheral area, the improvement wherein:

a) said nozzle means includes four spaced circular shaped jet emission locations (8) across said nozzle cross-section;

b) means are provided for creating a jet momentum in said emission locations (8) which is higher than in other locations of said nozzle cross-section; and c) the emission locations (8) are arranged in a circle (15) whose diameter is about 2.5 times the diameter of each emission location 8.

* * * * *